US009496127B2

(12) United States Patent
Owen et al.

(10) Patent No.: US 9,496,127 B2
(45) **Date of Patent: *Nov. 15, 2016**

(54) DIFFERENTIALLY PUMPED DUAL LINEAR QUADRUPOLE ION TRAP MASS SPECTROMETER

(71) Applicant: Purdue Research Foundation, West Lafayette, IN (US)

(72) Inventors: Benjamin C. Owen, West Lafayette, IN (US); Hilkka I. Kenttamaa, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/854,801

(22) Filed: Sep. 15, 2015

(65) Prior Publication Data

US 2016/0005586 A1 Jan. 7, 2016

Related U.S. Application Data

(63) Continuation of application No. 14/345,672, filed as application No. PCT/US2012/056909 on Sep. 24, 2012, now Pat. No. 9,165,754.

(60) Provisional application No. 61/537,949, filed on Sep. 22, 2011.

(51) Int. Cl.

| | |
|---|---|
| ***H01J 49/26*** | (2006.01) |
| ***H01J 49/42*** | (2006.01) |
| ***H01J 49/24*** | (2006.01) |
| ***H01J 49/00*** | (2006.01) |

(52) U.S. Cl.
CPC ..... *H01J 49/4225* (2013.01); *H01J 49/004* (2013.01); *H01J 49/24* (2013.01); *H01J 49/422* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 5,075,547 | A | 12/1991 | Johnson et al. | |
| 5,825,026 | A | 10/1998 | Baykut | |
| 6,121,607 | A | 9/2000 | Whitehouse et al. | |
| 6,528,784 | B1 | 3/2003 | Tang et al. | |
| 9,165,754 | B2 * | 10/2015 | Owen | H01J 49/24 |
| 2002/0121594 | A1 | 9/2002 | Wang et al. | |
| 2003/0226963 | A1 | 12/2003 | Cooks et al. | |
| 2006/0071665 | A1 | 4/2006 | Blake et al. | |
| 2006/0091308 | A1 | 5/2006 | Boyle et al. | |

(Continued)

OTHER PUBLICATIONS

Bollen, "Ion traps—Precision measurements and more," EUR Phys. J.A. 15, 237-243 (Oct. 2002).

(Continued)

*Primary Examiner* — Nicole Ippolito
(74) *Attorney, Agent, or Firm* — Adam M. Schoen; Brown Rudnick LLP

(57) ABSTRACT

The present disclosure provides a new tandem mass spectrometer and methods of using the same for analyzing charged particles. The differentially pumped dual linear quadrupole ion trap mass spectrometer of the present disclose includes a combination of two linear quadrupole (LQIT) mass spectrometers with differentially pumped vacuum chambers.

18 Claims, 14 Drawing Sheets

(56) References Cited

U.S. PATENT DOCUMENTS

| | | | |
|---|---|---|---|
| 2008/0142705 | A1 | 6/2008 | Schwartz et al. |
| 2009/0045334 | A1 | 2/2009 | Ding |
| 2010/0193680 | A1 | 8/2010 | Makarov et al. |
| 2010/0314538 | A1 | 12/2010 | Makarov et al. |
| 2012/0138788 | A1 | 6/2012 | Taniguchi |

OTHER PUBLICATIONS

European Extended Search Report mailed on Jun. 5, 2015 in European application No. 12833203.8.
International Preliminary Report of Patentability dated Dec. 18, 2012 from PCT/US2012/056909, (7 pages).
International Search Report dated Dec. 18, 2012 from PCT/US2012/056909, (3 pages).
Stirk et al., "Comparison of energy-resolved low-energy CAD of stable and isomerizing ions in an FT-ICR and in other tandem mass specrometers", International Jouranal of Mass Spectrometry and Ion Process, vol. 130, No. 3, Feb. 3, 1994, pp. 187-205.
Written Opinion dated Dec. 18, 2012 from PCT/US2012/056909, (6 pages).

* cited by examiner

- LQIT1 – Front Trap
  - Before Transfer:
    30,000 ions

- LQIT2 – Back Trap
  - After Transfer:
    9,000 ions

Concentrating ions – 8 ms

Ejecting ions – 1 ms

DIFFERENTIALLY PUMPED DUAL LINEAR QUADRUPOLE ION TRAP MASS SPECTROMETER

RELATED APPLICATIONS

The present application is continuation of Ser. No. 14/345,672, filed Mar. 14, 2014, which is a 35 U.S.C. §371 national phase patent application of PCT/US2012/056909, filed Sep. 24, 2012, which claims the benefit of and priority to U.S. provisional patent application Ser. No. 61/537,949, filed Sep. 22, 2011, the content of each of which is incorporated by reference herein in its entirety.

STATEMENT OF GOVERNMENT RIGHTS

The invention was made with government support under DE-SC0000997, awarded by the Department of Energy (DOE). The government has certain rights in the invention.

BACKGROUND

1. Field of the Disclosure

The present disclosure relates to a mass spectrometry. More particularly, the present disclosure relates to a linear quadrupole ion trap mass spectrometer (LQIT) for analysis and identification of samples or molecules.

2. Description of the Related Art

The analysis and identification of molecules and/or ions in samples has been conducted principally by use of ion trap mass spectrometers. Ion trapping mass spectrometers have played a role in broadening the field of mass spectrometry. In such analyzers, packets of ions with a range of m/z values (mass-to-charge ratios) are accumulated and manipulated in a confined space before they are detected.

Ion trapping mass spectrometers provide many advantages over other types of mass spectrometers, especially mass spectrometers which separate ions by using electric and/or magnetic fields, allowing only ions of a single m/z value to have stable trajectories to the detector at a given time. Ion trapping mass spectrometers allow many more ion manipulating steps that these traditional mass spectrometers. As such, ion trapping mass spectrometers provide a powerful tool in the structural characterization of ions and isomer differentiation.

SUMMARY

The present disclosure provides a differentially pumped dual linear quadrupole ion trap mass spectrometer including a combination of two linear quadrupole ion trap (LQIT) mass spectrometers with differentially pumped vacuum chambers for analyzing charged particles.

According to an embodiment of the present disclosure, a mass spectrometry system is provided. The mass spectrometry system includes a first linear quadrupole ion trap mass spectrometer; a second linear quadrupole ion trap mass spectrometer configured to analyze the mass-to-charge ratio of a charged particle provided from the first linear quadrupole ion trap mass spectrometer; and a vacuum manifold configured to allow the charged particle to travel from the first linear quadrupole ion trap mass spectrometer to the second linear quadrupole ion trap mass spectrometer.

In some embodiments of the mass spectrometry system, the system also includes a first multipole and a first lens configured to direct the charged particle to be received by the first linear quadrupole ion trap mass spectrometer; and a second multipole and a second lens configured to direct the charged particle to be received by the second linear quadrupole ion trap mass spectrometer.

According to another embodiment of the present disclosure, a method of analyzing the mass-to-charge ratio of at least one charged particle is provided. The method includes performing a first gas phase ion reaction on a first quantity of particles in a first linear quadrupole ion trap mass spectrometer; transferring at least a portion of the first quantity of particles to a second linear quadrupole ion trap mass spectrometer; performing a second gas phase ion reaction on at least a portion of the first quantity of particles in a second linear quadrupole ion trap mass spectrometer; and determining with the second linear quadrupole ion trap mass spectrometer the mass-to-charge ratio of at least one of the at least a portion of the first quantity of particles.

BRIEF DESCRIPTION OF THE DRAWINGS

The above-mentioned and other features and advantages of this disclosure, and the manner of attaining them, will become more apparent and the disclosure itself will be better understood by reference to the following description of embodiments of the disclosure taken in conjunction with the accompanying drawings, wherein.

Corresponding reference characters indicate corresponding parts throughout the several views. The exemplifications set out herein illustrate exemplary embodiments of the disclosure and such exemplifications are not to be construed as limiting the scope of the disclosure in any manner.

DETAILED DESCRIPTION

Figure 1:
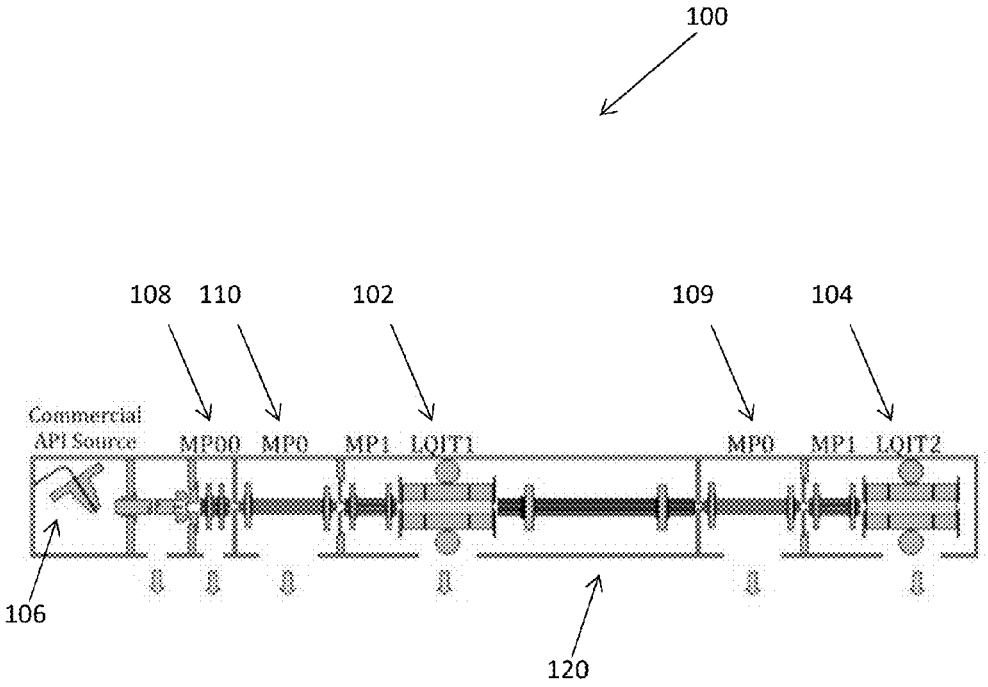
FIG. 1 is a schematic of an embodiment of a differentially pumped dual LQIT according to the present disclosure.

Ion trap mass spectrometers have helped broaden the field of mass spectrometry. In these analyzers, packets of ions with a range of m/z values are accumulated and manipulated in a confined space before they are detected.

According to the present disclosure, an analysis mechanism, utilizing an ion trap mass spectrometer is provided which imparts advantages over other types of mass spectrometers, such as quadrupole mass filters and magnetic sectors, which separate ions by using electric and/or magnetic fields that allow only ions of a single m/z value to have stable trajectories to the detector at a given time. In general, ion trap mass spectrometers demonstrate better sensitivity as ions can be accumulated for certain periods of time so that ions of lower abundance can be detected. The accumulated ions can be isolated so that only desired ions remain in the trap, and then subjected to gas phase ion reactions. Exemplary gas phase ion reactions include collision-activated dissociation ("CAD"), photon-induced dissociation, ion-molecule reactions, and ion-ion reactions.

CAD causes the ions to engage in energetic collisions with gaseous atoms, causing them to fragment. The CAD process aides in obtaining information on the ions' structures. Furthermore, storing the ions for a variable time period aides in the examination of the ions' ion-molecule and ion-ion reactions.

As discussed herein, in ion-molecule and ion-ion reactions, the ions of interest are held in the ion trap and allowed to react through soft gas-phase collisions with neutral molecules or other ions with an opposite charge that are introduced into the same space as the trapped ions. These reactions, as disclosed herein, may provide more detailed information than dissociation reactions and are useful tools for the structural characterization of ions. More specifically, ion/molecule reactions aide in the identification, and the counting, of functionalities and isomer differentiation.

The ability of mass spectrometry to produce structural data similar to that obtained from nuclear magnetic resonance (NMR) spectroscopy by using a combination of CAD and ion/molecule reactions has been demonstrated by using dual-cell Fourier transform ion cyclotron resonance (FT-ICR) mass spectrometers. However, this process requires the CAD process and the ion-molecule reactions to be performed in separate clean environments that are maintained through the use of differential pumping. These two different types of reactions need to be performed in separate clean environments as they otherwise interfere with each other. For example, during CAD, the fragment ions may react with the reagent molecules intended for later ion-molecule reactions, and thus reduce their abundance at the later ion-molecule reaction. Further, reaction of the fragment ions with the reagent molecules may generate ions not related to the CAD process. Additionally, dual-cell FT-ICR mass spectrometers have become obsolete and, in general, lack the sensitivity, flexibility and ease of use of newer commercial ion trap mass spectrometers.

Referring to FIG. 1, a configuration of a differentially pumped dual linear quadrupole ion trap mass spectrometer 100 according to the present disclosure is disclosed. Construction of DQLIT 100 included removal of the back vacuum manifold cover of LQIT1 102, as well as the front vacuum manifold cover of LQIT2 104. When removing the cover on LQIT2 104, various necessary ion optics for traditional ion introduction from an atmospheric pressure ionization (API) source were also removed. Most notably, the API stack was removed, which includes the sweep cone, ion transfer capillary, and tube and skimmer lenses (not shown). DQLIT 100 includes an ion source. Illustratively, ion source is an API source 106 source, but other ion sources may also be used.

Figure 2A:
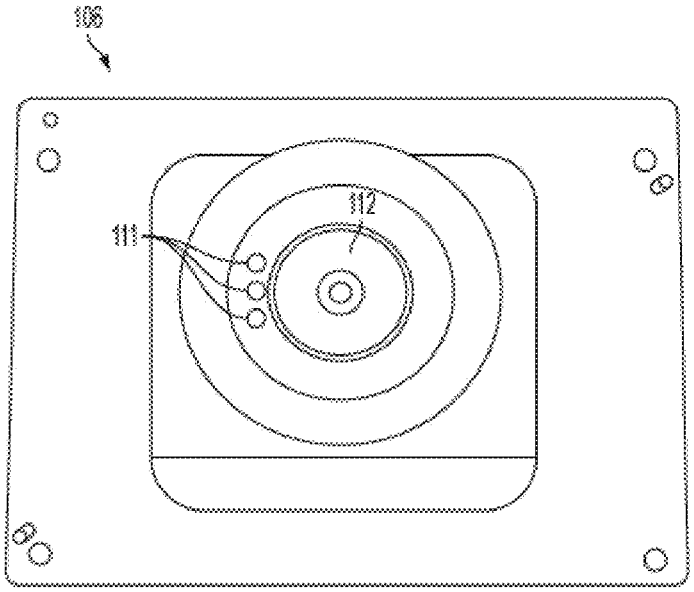
FIG. 2A is a back view of an API source housing according to the present disclosure, showing the lens 0 housing and the three contacts that are supplied voltage by the MP0 shown in FIG. 2B.
Figure 2B:
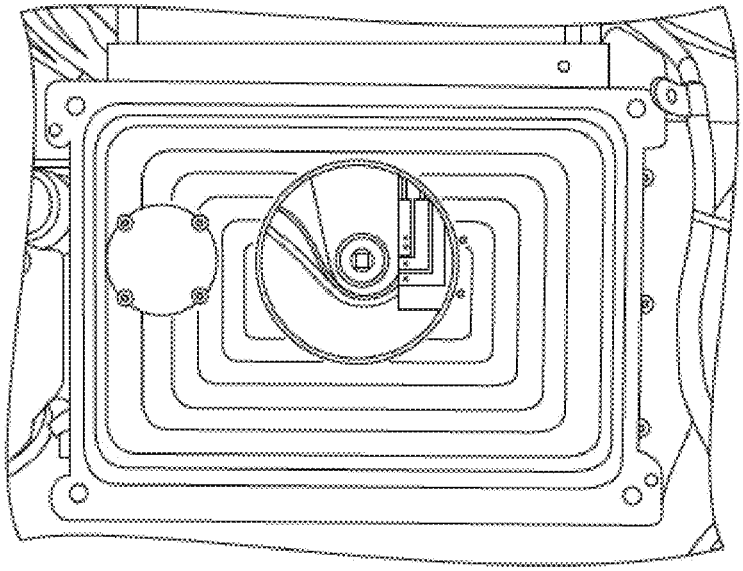
FIG. 2B is a front view of an MP0 according to the present disclosure.

Referring to FIGS. 2*a* and 2*b*, the housing for the API stack was also removed. This housing not only seals off the main vacuum manifold chamber from atmosphere but it also contains the necessary electrical connections for the API stack, which are no longer necessary.

An ion introduction device, illustratively ion introduction multiple (MP00) 108 (FIG. 1) transfers ions from API 106 towards LQIT1 102. In the illustrative embodiment, the ion introduction multipole (MP00) 108 (FIG. 1) and a subsequent lens (lens0 112, FIG. 2A) are positioned between API 106 and LQIT1 102. Lens0 112 (FIG. 2A) focuses ions into first multipole (MP0) 110 (FIG. 1). First multipole (MP0) 110 is positioned to allow ions to travel from ion introduction multipole (MP00) 108 into LQIT1 102. Although illustrated as a multipole, other suitable devices for transferring ions may also be used. A second multipole (MP0) 109, similar to first multipole (MP0) 108, is positioned to allow ions to travel from vacuum manifold 120 into LQIT2 104.

The ion introduction multipole (MP00) 108 and lens0 112 are supplied voltage by three gold spring pins 111 that are fed from the main RF and DC supplies of the instrument (FIG. 2A). This portion of DLQIT 100 also acts as a two stage vacuum baffle to lower the final pressure of the instrument to approximately $10^{-5}$ torr from atmospheric pressure. Lens0 112 housing acts as a vacuum baffle between 100 mtorr and approximately $10^{-3}$ torr and also houses the contacts for supplying voltage to the ion introduction multipole (MP00) 108 and lens0 112. In addition, the API housing holds the vacuum port for the evacuation of the API stack 106 and ion introduction multipole (MP00) 108.

Figure 3:
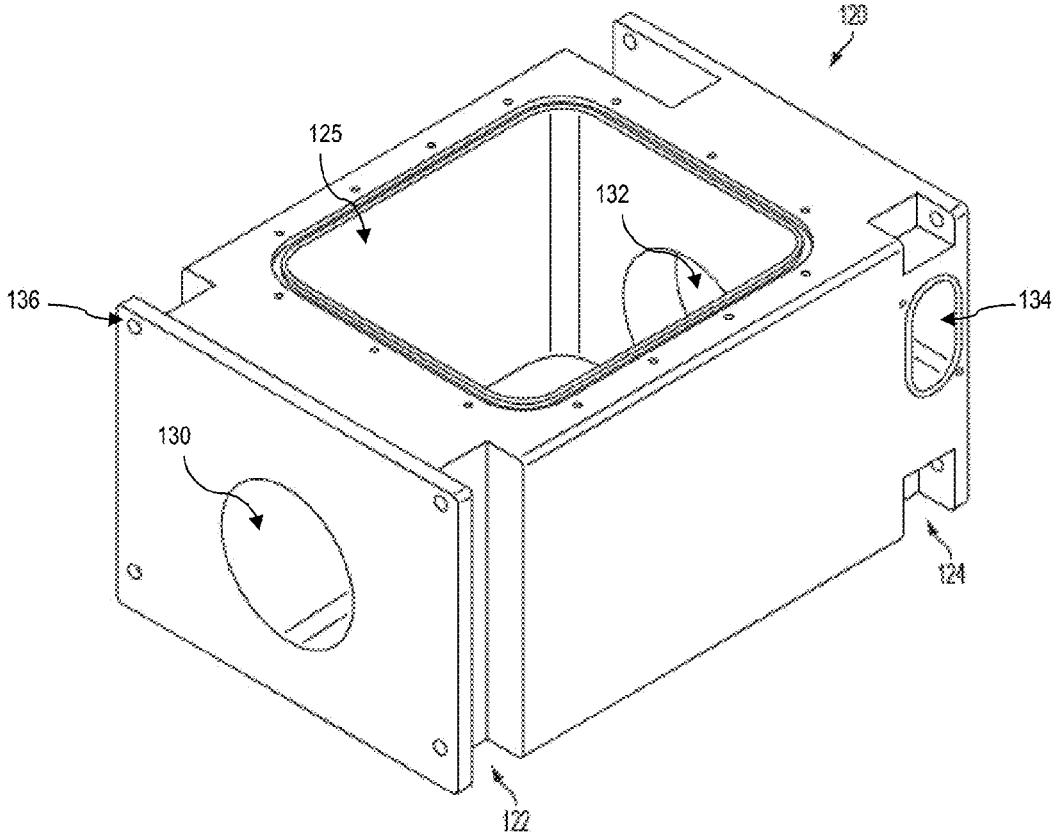
FIG. 3 is a schematic depicting a perspective view of a new manifold according to the present disclosure.

Referring to FIG. 3, a vacuum manifold 120 of the DQLIT 100 is shown. According to the instant disclosure, vacuum manifold 120 connects LQIT1 102 and LQIT2 104 and houses a third multipole provided by Thermo Fisher Scientific. According to one configuration, the third multipole is approximately 11.77 inches long. First ion passageway 130 and second ion passageway 132 through vacuum manifold 120 allow ions to pass through vacuum manifold 120 between LQIT1 102 and LQIT2 104.

The front and back flanges 122, 124, respectively, of the new bridging vacuum manifold 120 were designed to mimic that of the back vacuum manifold flange of LQIT1 102 and the front vacuum manifold flange of LQIT2 104, respectively, for facile integration. Illustratively, vacuum manifold 120 further includes one or more fastener ports 136 to assist in securing vacuum manifold 120 to LQIT1 102 and LQIT2 104. In the illustrative embodiment, port 134 is provided on a side of vacuum manifold 120.

Figure 4A:
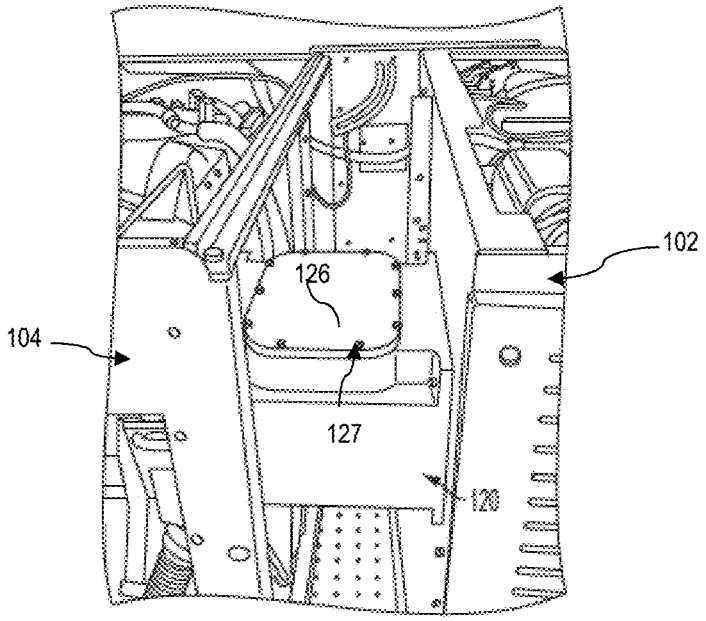
FIG. 4A is perspective image of a new manifold in an embodiment of a differentially pumped dual LQIT according to the present disclosure.
Figure 4B:
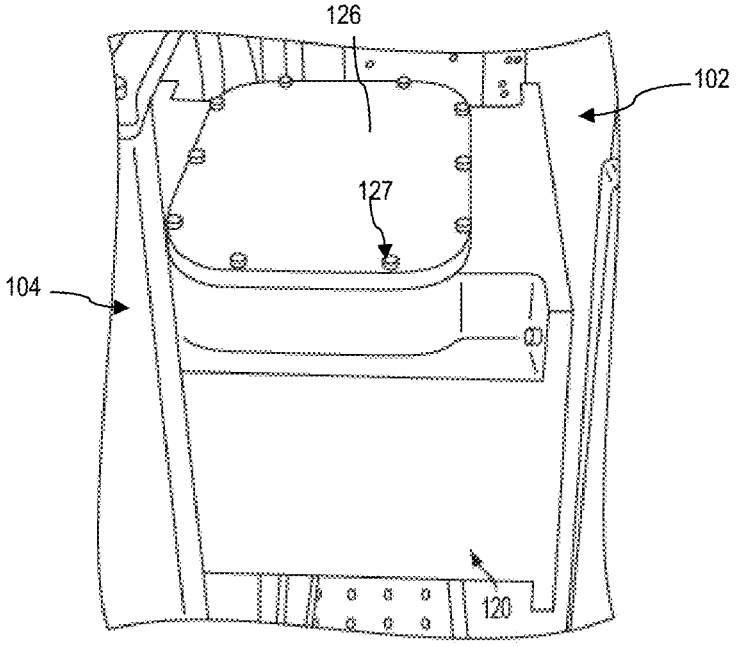
FIG. 4B is another perspective image of a new manifold in an embodiment of a differentially pumped dual LQIT according to the present disclosure.

As shown in FIG. 3, the top 125 of the vacuum manifold 120 was left open to allow for easy introduction of a multipole in the vacuum manifold to create a cohesive ion optics system that allows ions to travel from LQIT1 102 to LQIT2 104. A cover 126 is provided over the opening in top 125 and secured with fasteners 127 as shown in FIGS. 4A and 4B. Thus, a top flange was also provided. Inside this "boat-shaped" manifold, a support is provided for the multipole to minimize any sagging. A second support is also provided for the introduction of the multipole into LQIT2 104 that mimicked the vacuum baffle housing for lens 0 112 (FIG. 2A). According to some configurations of DQLIT 100, these supports are simply circular sections of PEEK plastic material that are shaped to fit the middle and end sections of the transfer multipole. Specifically, the support created for the introduction into LTQ2 104 was integrated with long screws to replace the old contact leads of MP00 108 and use the same power that would have been supplied to MP00 108 to supply this new multipole. The manifold 120 was also constructed with a locking screw for this support that can be manipulated outside of the manifold and a vacuum seal for it. In addition, the manifold 120 includes a vacuum port flange to connect and plug the vacuum line that pumped the housing of API 106 to the manifold 120. This was done to allow for efficient forepumping of the turbo that evacuates the main vacuum manifold and for monitoring of this pressure.

Referring to FIGS. 4A and 4B, the engineered vacuum manifold 120 is coupled to the DQLIT 100 as shown. Once connected, the vacuum manifold 120 is placed under vacuum for verification that no leaks to atmosphere are present. In the illustrative embodiment, introduction multipole (MP00) 108 and first multipole (MP0) 110 provide a cohesive path for ions from ion source 106 to LQIT1, and the multipole in the manifold and second multipole (MP0) 109 provide a cohesive path for ions from LQIT1 102 to LQIT2 104.

In the illustrative embodiment shown in FIG. 1, LQIT1 102, LQIT2 104 and vacuum manifold 120 are arranged linearly. In another embodiment (not shown), vacuum manifold 120 includes an angle such that the path traveled by an ion between LQIT1 102 and the vacuum manifold 120 is at an angle to the path traveled by the ion between the vacuum manifold 120 and and LQIT2 104.

Figure 5:
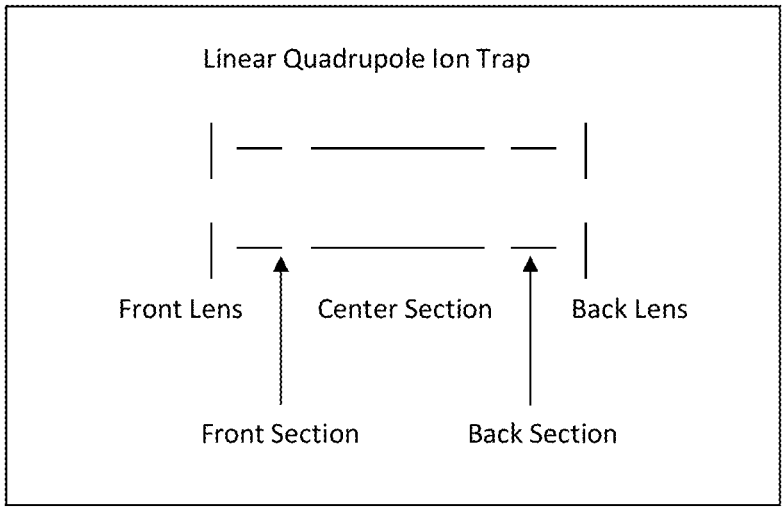
FIG. 5 is schematic depicting the definitions for the sections of the ion trap that can be depicted as a DC pseudo-potential well where the center section is the lowest point of the DC well.

New ion trap control language (ITCL) was provided to allow the transfer of ions axially out of the back of the ion trap in LQIT1 102. The ITCL code disclosed and utilized herein, involves the addition of various DC voltage increases and decreases to the ion trap section voltages to facilitate efficient transfer of the ions. Referring to FIG. 5, a schematic of the sections pertinent to the ion trap is depicted. New definition values were also given to the trap sections when in axial ejection mode to allow for easy control and tuning via the user interface (UI). The new definition values are given in Table 1.

TABLE 1

New variable definitions for the axial ion ejection mode and control variables in UI.

| New Variable | Default Value | Controlled by in UI |
|---|---|---|
| Lensoffset | 6 | Multipole 00 Offset |
| Trapoffset | 0 | Intermediate Lens 0 Voltage |
| Backsoffset | −2 | Multipole 0 Offset |
| Backlpulse | −5 | Intermediate Lens 1 Voltage |
| Axialejectflag | 0 | Capillary Voltage |
| Axialejecttime | 0.7 | Gate Lens Voltage |
| Transferoffset | 6 | Front Lens Voltage (not used) |
| Transfertime | 3 | Multipole RF Amplitude |
| Additional | 8 | Multipole 1 Offset |

Figure 6:
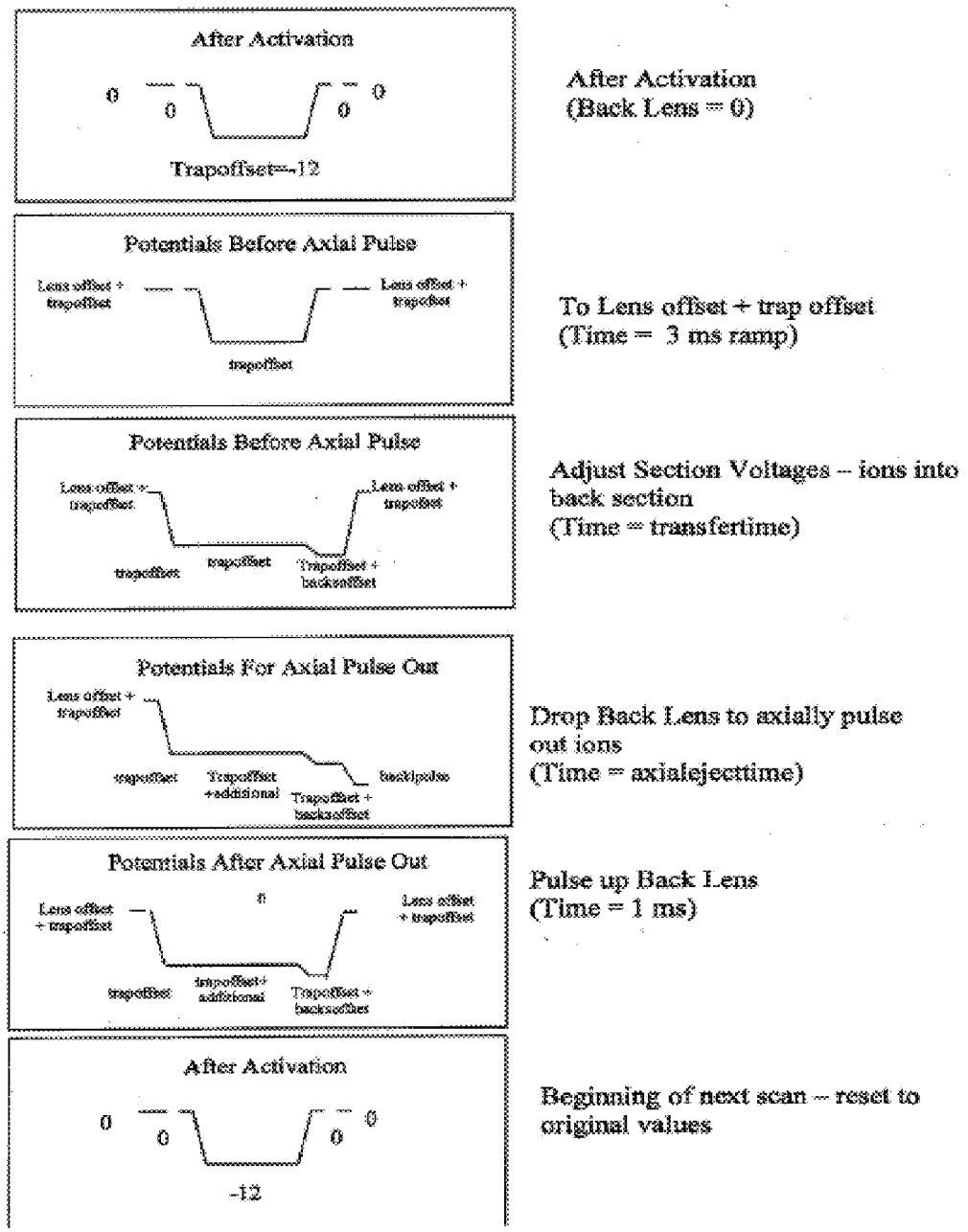
FIG. 6 is a schematic depicting an ion trap axial eject mode sequence of a differentially pumped dual LQIT according to the present disclosure.
Figure 7:
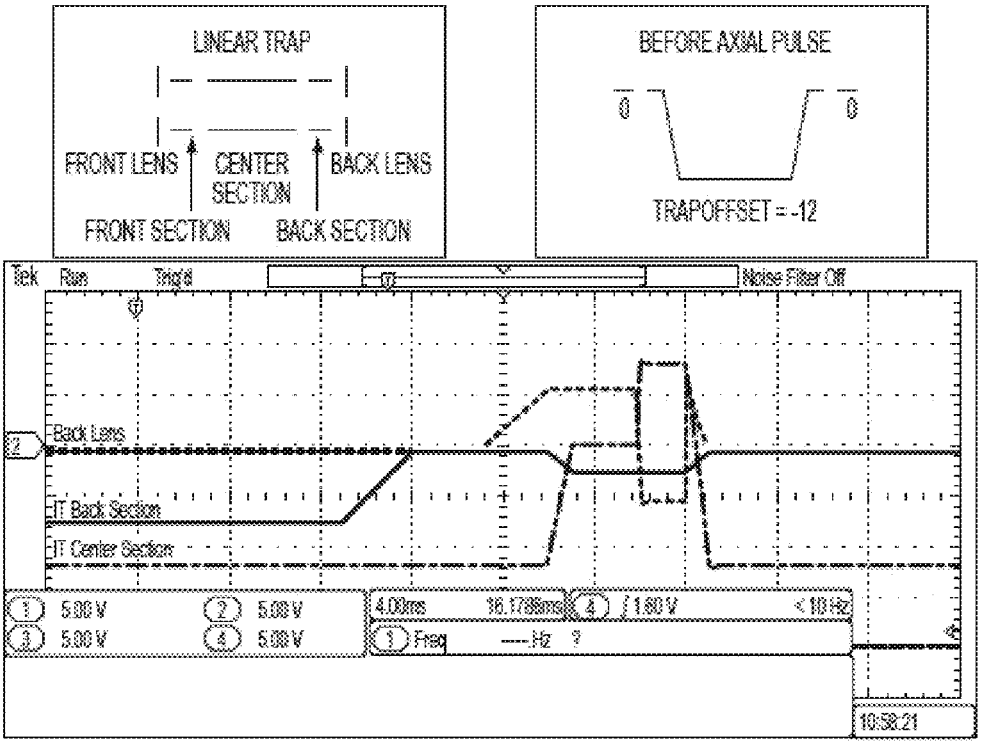
FIG. 7 is an oscilloscope read out of the applied DC potentials on a center section of a ion trap, the back section of the ion trap, and the back lens, of a differentially pumped dual LQIT according to the present disclosure.

Referring to FIG. 6, a schematic of the implementation of the new definition values given to the trap sections when in axial ejection mode is provided. Additionally, pseudo-potential wells created by the DC offsets on the different trap sections are also shown in FIG. 6. With reference to FIG. 7, an oscilloscope was connected to existing probes in the analog board of LQIT1 102 to monitor the changes in ITCL code being implemented.

According to the system disclosed herein, the axial ion ejection is based on a drop in the DC potential in the axial direction so that ions are ejected out of the trap and travel into the implemented multipole that transfers ions into MP0 110 of LQIT2 104. According to configurations of the present disclosure, this is achieved by the following steps:

(1) the DC voltage of the back and front section of the trap are raised thus increasing the walls of the pseudo-potential well and concentrating ions into a tighter packet in the center of the trap;

(2) the DC voltage on the back section of the trap is lowered while the DC voltage on the center section is set to be higher than the back section (the DC voltage on the front section is raised simultaneously with the center section of the trap taking the previously concentrated and tight packet of ions and transferring the ion packet into the back section of the trap);

(3) holding the applied DC voltage on the back section of the trap constant while dropping the DC voltage applied to the back lens below the voltage applied to the back section and while the center section DC voltage ramps higher above both the back section and back lens (causing the concentrated ion packet centered in the back section of the ion trap to begin exiting the trap through the back lens), and holding these voltages at these values for a determined amount of time to ensure efficient ejection of the ion packet, a process termed "axial eject time;" and (4) Upon ejection of the ion packet, the voltage on the back lens is pulsed-up to close the ion gate and thereafter all applied voltages return to post-injection values.

Referring to FIG. 7, a screen capture of an oscilloscope read-out gained from the probes reading, the applied voltages on the appropriate trap sections that were connected to the LQIT analog board, is shown.

Additionally, the DQLIT 100 and methods disclosed herein demonstrate a synchronization of the various components of the system. According to a configuration of the disclosed DQLIT 100, the instruments' integrated trigger system may be used to allow the DQLIT 100 to trigger the collection of discrete ion packets such that that a single ion packet collected in the front instrument (e.g., LQIT1 102) may be transferred into the back instrument (e.g., LQIT2 104) while the front instrument is not continually collecting and ejecting new ion packets during this transfer process. This synchronization avoids any possible overlap of ion packet collection that may currently be occurring.

In addition to the DQLIT 100 disclosed herein, ion-molecule reagent manifolds may be used for testing the efficiency of the vacuum system (employed by the DQLIT 100). Testing the efficiency of the vacuum system provides indications regarding whether changes in the pumping (e.g., pumping efficiency) are required for generating and maintaining separate and clean reaction environments with DQLIT 100.

According to DQLIT 100 and methods disclosed herein, the DQLIT 100 may also be tested for the presence/absence of gas impurities and other reactive species, such as $O_2$(g), native to higher pressure mass spectrometers with API sources. Such testing, according to the instant disclosure, may be carried out by the generation and examination of reactions of highly reactive species, such as charged polyradicals, in LQIT1 102 and comparing their behavior in LQIT1 102 and LQIT2 104. According to the system and methods disclosed herein, interfering reactions should be drastically reduced in LQIT2 104.

To assess the performance of the constructed instrument, varying samples were analyzed by using experiments involving CAD and ion/molecule reactions. The performance and initial characterization of the instrument with regards to ion transfer and effects of differential pumping are discussed below.

Example 1

Efficiency of Ion Transfer

Example 1.1

Broad Range Calibration Solution

Figure 8A:
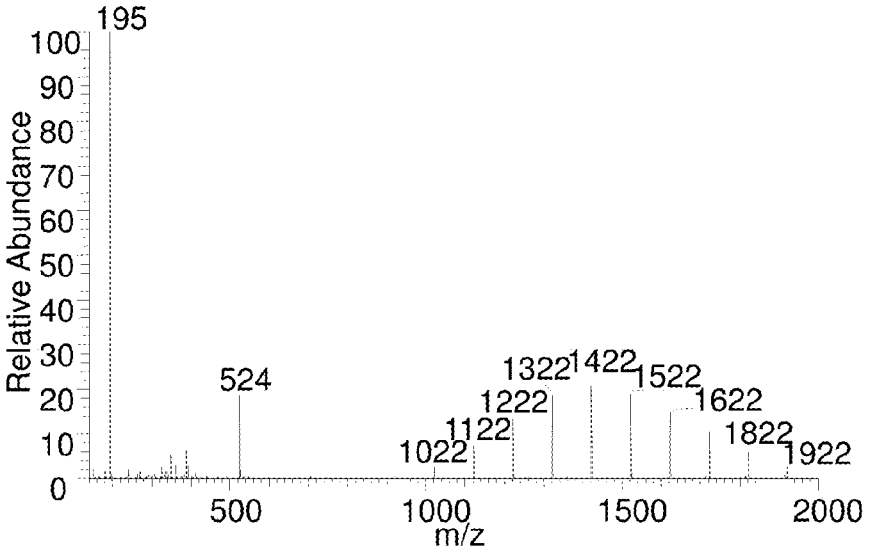
FIG. 8A is a graph showing mass spectral measurements for a sample collected in the back LQIT after transferring the ion packet through the front LQIT into the back LQIT.
Figure 8B:
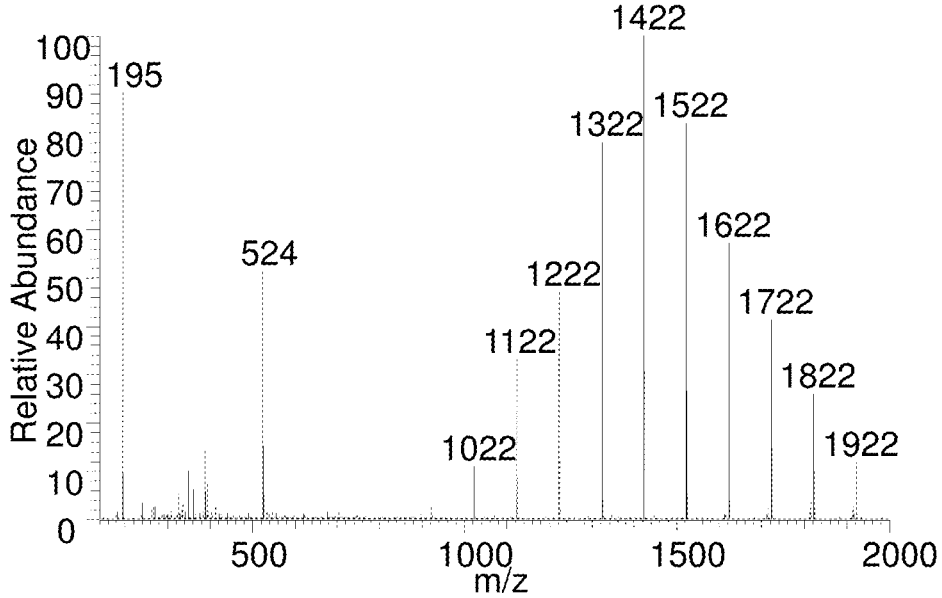
FIG. 8B is a graph showing mass spectra measurements for a sample collected in the back LQIT after transferring the ion packet through the front LQIT into the back LQIT.

To evaluate the efficiency of transfer of ions from LQIT1 102 into LQIT2 104, the Thermo calibration solution was utilized with positive-ion mode ESI. After recording a mass spectrum in LQIT1, axial ejection of the ions was performed and the mass spectrum was recoded in LQIT2. All LQIT1 ejection voltages and their timing and LQIT2 injection voltages and their timing were tuned for maximum total ion current (TIC) after ion transfer. FIGS. 8*a* and 8*b* and Table 2 give the results of this experiment.

With reference to FIGS. 8A and 8B, the ability to transfer ions according to the DQLIT 100 and methods disclosed herein was tested. A stable signal was acquired in LQIT1 102 for testing the transfer of ions. FIG. 8A shows the ions present in the front trap of LQIT1 102 prior to the transfer. Axial eject mode was entered on LQIT1 102 and ions were injected into the multipole in the new vacuum manifold 120 and subsequently into MP0 109 of LQIT2 104 where the ion injection system was configured to utilize long injection times to ensure that the ion packet was collected. FIG. 8B shows the ions present in the back trap of LQIT2 104 after the transfer. As shown by the mass spectra measurements in FIGS. 8A and 8B and collected in Table 2, approximately 30% of ions were transferred, demonstrating the DQLIT 100 and methods disclosed herein are functional.

TABLE 2

| Total Ion Count for Thermo calibration solution | | |
|---|---|---|
| | LQIT1 - Front Trap Before Transfer | LQIT2 - Back Trap Following Transfer |
| Total Ion Count | $3 \times 10^4$ | $9 \times 10^3$ |

From the above results, the transfer efficiency of the trapped ions with a wide mass range can be calculated by dividing the total ion count transferred into LQIT2 104 into the total ion count in LQIT1 102 prior to transfer, which is determined to be about 30%, meaning that about 30% of the original ions in LQIT1 were transferred into LQIT2.

Figure 9:
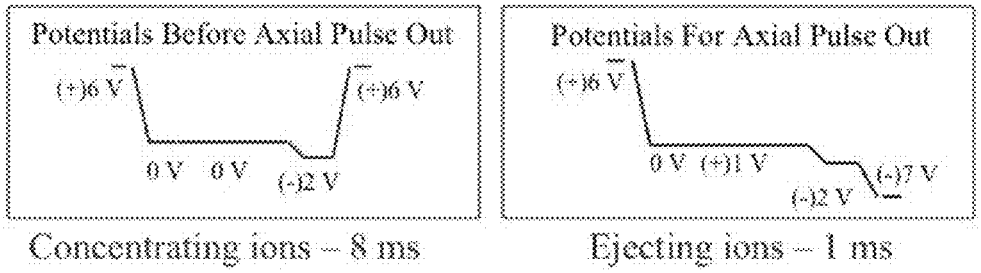
FIG. 9 is a schematic of the optimal voltages and timing for the ejection of ions from LQIT1.

The optimal voltages and timing for the ejection of ions over a large mass range from LQIT1 102 are given in FIG. 9.

Example 1.2

Isolation of Ions of a Single m/z Value—Protonated MRFA

In a different experiment, ions of a single m/z value were isolated before transfer by ejecting all other ions out, and the ion was transferred into LQIT2 by optimizing the voltages and their timing to minimize mass biasing of the selected ion. When this was performed for the protonated molecule of MRFA in the calibration solution (m/z 524), the transfer efficiency into LQIT2 was increased to 40-50%.

Example 2

Differential Pumping Efficiency

Differential pumping was accomplished in this instrument through the use of separate reaction chambers containing the two ion traps in different vacuum manifolds that were evacuated through the use of different turbo pumps. LQIT1 102 used the final stage of a triple-port Oerlikon Leybold turbo pump to reach final pressure in the mass analyzer vacuum manifold, with this turbo being forepumped by two Edwards EM30 rough pumps (foreline pressure of ~1 Torr). LQIT2 104 used all three stages of a triple-port Oerlikon Leybold turbo pump to evacuate its vacuum manifold. Also this turbo pump was forepumped by two Edwards EM30 rough pumps (foreline pressure lower than 100 mTorr). The vacuum manifold 120 connecting the two linear ion traps 102, 104 is evacuated by the turbo pumps of both instruments, as no external or additional pumping device was placed on the new vacuum manifold 120.

Regardless, the background pressures, as read by ion gauges, of the two vacuum manifolds housing the mass analyzers 102, 104 were maintained at different pressures. The background pressure of LQIT1 102 and LQIT2 104 were monitored when the He line was closed and the API inlet of the LQIT 102, 104 was left unplugged to leak in a typical flow of ambient gases. Under such conditions, LQIT1 102 was maintained at $1.9\times10^{-5}$ Torr, while LQIT2 104 was maintained at $1.0\times10^{-5}$ Torr. These results suggest that there is some decrease in pressure between the two vacuum manifolds. Furthermore, the overall background pressure of both LQITs 102, 104 is significantly lower when compared to the background pressure of an unaltered LQIT ($2.5\times10^{-5}$ Torr). These results suggest that the pumping efficiency of the DLQIT 100 is better than for a single LQIT, as expected.

Example 3

Interference with CAD Reactions Utilizing 9-Fluorenone-4-carboxylic Acid

To investigate the utility of the new instrument for experiments wherein background gases, such as water, interfere with CAD reactions in an $MS^3$ experiment, 9-fluorenone-4-carboxylic acid was employed. $MS^3$ is an experiment wherein an ion has been isolated from a mixture, fragmented or allowed to undergo ion-molecule reactions (an $MS^2$ experiment), and a product ion has been isolated and fragmented or allowed to undergo ion-molecule reactions. In this experiment, the 9-fluorenone-4-carboxylic acid (m/z 225) was protonated by using positive-ion mode APCI, isolated and subjected to CAD, an exemplary $MS^2$ experiment, in a single-trap LQIT and in the DLQIT.

Figure 10:
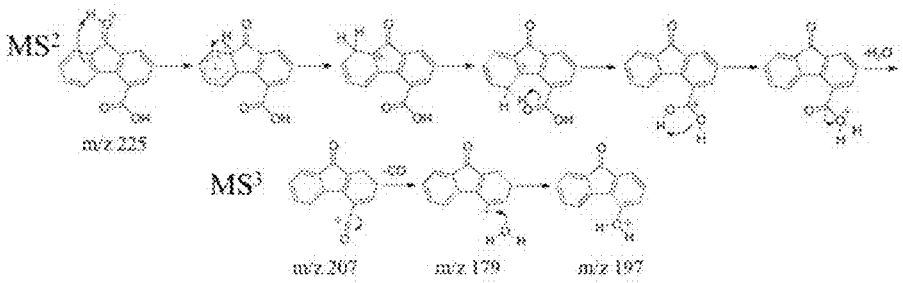
FIG. 10 is an illustration of mechanisms for the formation of the product ions upon CAD of protonated 9-fluorenone-4-carboxylic acid by loss of water (ions of m/z 207) and subsequent loss of CO (ions of m/z 179) followed by addition of water to the CO loss product ion (ions of m/z 197)
Figure 11A:
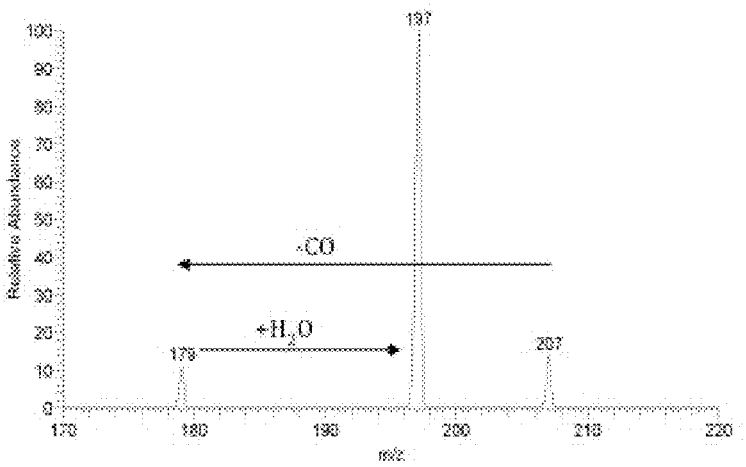
FIG. 11A is a $MS^3$ spectrum of the ion of m/z 207 formed from water loss upon CAD of protonated 9-fluorenone-4-carboxylic acid (m/z 225) in a single-trap LQIT.
Figure 11B:
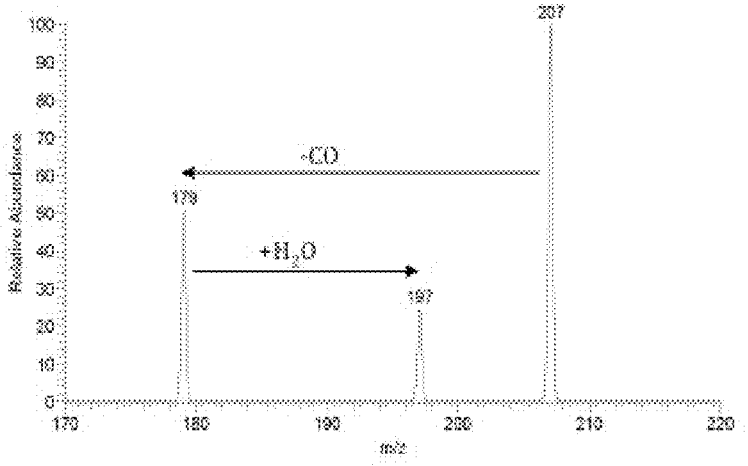
FIG. 11B is a $MS^3$ spectrum of the ion of m/z 207 formed from water loss upon CAD of protonated 9-fluorenone-4-carboxylic acid (m/z 225) in the front trap of a DLQIT.
Figure 11C:
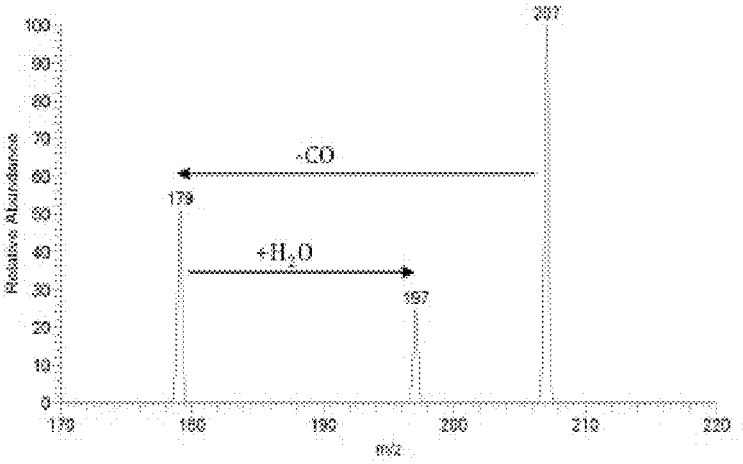
FIG. 11C is a $MS^3$ spectrum of the ion of m/z 207 formed from water loss upon CAD of protonated 9-fluorenone-4-carboxylic acid (m/z 225) in the back trap of a DLQIT.

As illustrated in FIG. 10, upon CAD, the protonated molecule of 9-fluorenone-4-carboxylic acid rapidly loses water (to yield an ion of m/z 207). When the product ion (m/z 207) was subjected to CAD, an exemplary $MS^3$ experiment, it yielded two product ions: (1) an ion of m/z 179 resulting from the loss of CO and (2) and ion of m/z 197, which results from addition of adventitious water to the ion resulting from loss of CO (m/z 179). This reaction was used as a probe to test any observable differences in the ion abundances of these mass spectrometry fragmentation ($MS^3$) product ions when CAD was performed in different background pressure environments of different LQITs. As such, this reaction sequence was performed in three ways: 1) $MS^3$ in a single-trap LQIT, the results of which are shown in FIG. 11A, 2) $MS^3$ performed in the ion trap associated with LQIT1 102 ("front trap") of the DLQIT 100, the results of which are shown in FIG. 11B, and 3) tandem mass spectrometry ($MS^2$) performed in the front trap of the DLQIT 100 and the transfer of ions of m/z 207 into the ion trap associated with LQIT2 104 ("back trap") of the DLQIT 100 where $MS^3$ was performed, the results of which are shown in FIG. 11C. The activation time (30 ms) or reaction time allowed for all of these experiments was the same. The branching ratios of the product ions for these experiments are given in Table 3. As can be seen in Table 3, the amount of water in both traps of the DLQIT 100, shown in FIGS. 11B and 11C is decreased when compared to the amount of water in a single-trap LQIT, shown in FIG. 11A. This is evident through the observation of a lower abundance of the ion of m/z 197 formed upon $MS^3$ in the lower pressure environments of the DLQIT 100. Additionally, the back trap of the DLQIT 100 has the lowest partial pressure of adventitious water, overall, as the ion of m/z 197 was at its lowest abundance in this trap (LQIT2) in these experiments.

TABLE 3

Branching ratios of the product ions produced upon CAD of protonated 9-fluorenone-4-carboxylic acid.

| Single-trap LQIT | | Front Trap of DLQIT | | Back Trap of DLQIT | |
|---|---|---|---|---|---|
| m/z 179 | 16% | m/z 179 | 68% | m/z 179 | 74% |
| m/z 197 | 84% | m/z 197 | 32% | m/z 197 | 26% |

Example 4

Figure 12A:
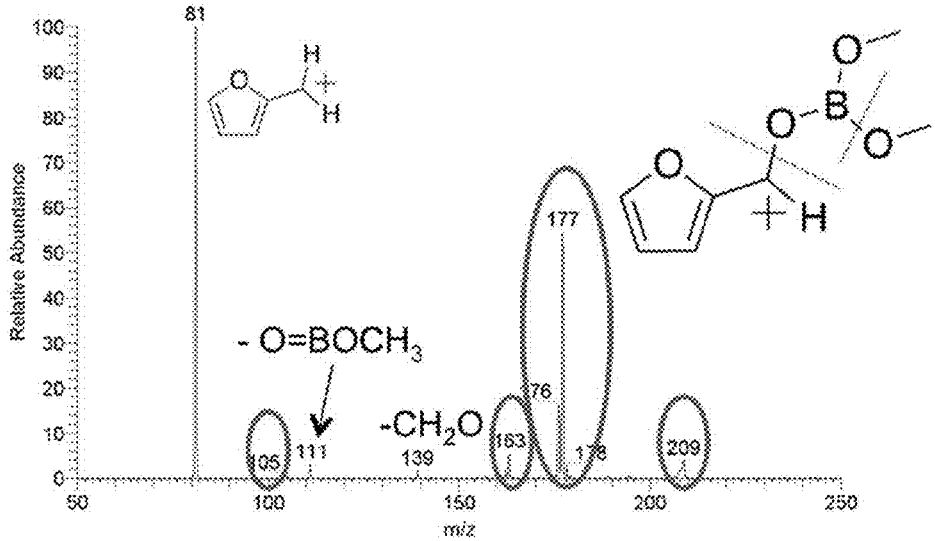
FIG. 12A is a $MS^3$ spectrum showing CAD of the TMB adduct ion formed from protonated furfural (m/z 169) upon addition to TMB and accompanied by loss of methanol in the front trap of the DLQIT in the presence of the ion/molecule reagent.
Figure 12B:
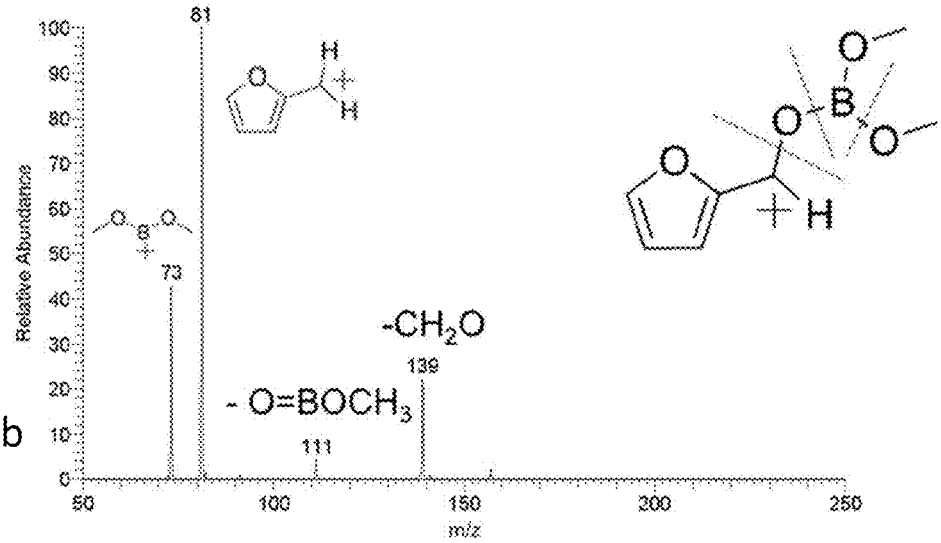
FIG. 12B is a $MS^3$ spectrum showing CAD of the TMB adduct ion formed from protonated furfural (m/z 169) upon addition to TMB and accompanied by loss of methanol in the back trap of the DLQIT without the presence of TMB.

Performance of an Ion/Molecule Reaction in Tandem with CAD Reactions Using Trimethyl Borate and Protonated Furfural For examining the capability of the DLQIT to perform ion/molecule reactions in tandem with CAD reactions, an ion/molecule reaction between trimethyl borate (TMB) and protonated furfural was chosen to facilitate the structural characterization of this molecule. Furfural is a molecule based on a furan backbone, a group of important molecules for the pyrolysis of biomass. In this experiment, the neutral reagent (TMB) was introduced through the implemented ion/molecule reagent manifold connected to the helium line of the front trap of the DLQIT 100. Upon generation of the protonated furfural (m/z 97) via positive-ion-mode ESI, the protonated molecule is isolated and allowed to react with TMB for 30 ms to give an adduct ion that has lost methanol (m/z 169; The presence of a ion at +72 m/z units from the original ion is a diagnostic reaction of this reagent that reveals the presence of an oxygen). The TMB adduct ion is isolated, and $MS^3$ CAD is performed in the front trap of the DLQIT 100 where the ion/molecule reagent is still present to simulate the reaction in a single-trap LQIT, the results of which are shown in FIG. 12A. Next, the isolated ion is transferred into the back trap of the DLQIT where CAD is performed to examine the advantage of having two differentially pumped reaction chambers, the results of which are shown in FIG. 12B.

With the dual-pressure chambers of the DLQIT, all undesired ion/molecule reaction products that result from the reaction of the CAD product ions with residual TMB were eliminated. Furthermore, more information was gained on the TMB adduct formed from the reaction of TMB with protonated furfural. This is evident through the observation of a new product ion (dimethoxy borinium cation; m/z 73). If TMB is present, this ion of m/z 73 will react away very quickly to form an adduct with TMB (m/z 177) as can be seen in FIG. 12A. Secondary reaction products, such as ions like m/z 177, are undesirable as they are difficult to distinguish from primary product ions, and they result in the unnecessary complication of the mass spectrum. Through the use of the DLQIT to perform this experiment, only the product ions that directly result from the CAD of ion/molecule product ions are observed. It is clearly demonstrated by the data presented, herein, that CAD and ion/molecule reactions can be performed in tandem without the interference of these two reaction types.

Example 5

Figure 13A:
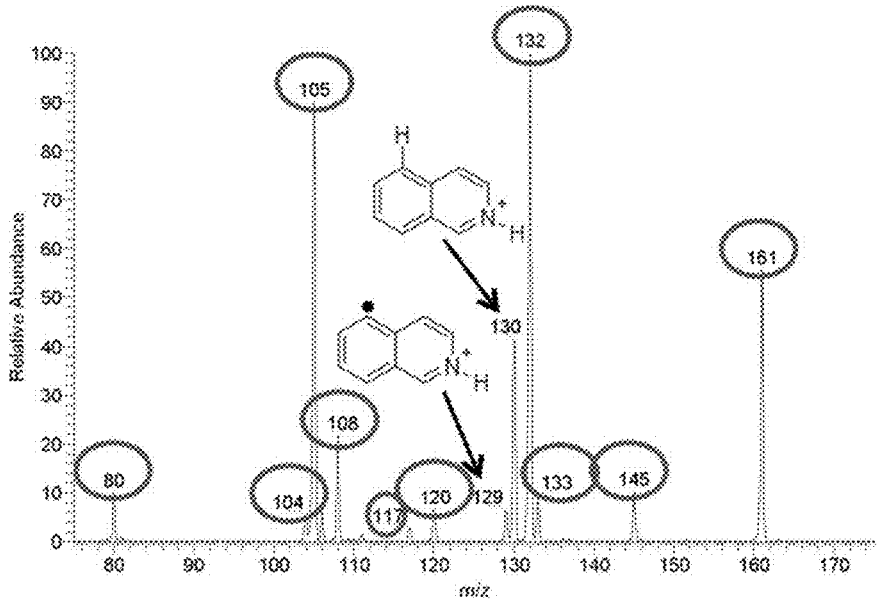
FIG. 13A is the mass spectrum measured after 500 ms reaction of the 5-dehydroisoquinolinium cation with cyclohexane in a single-trap LQIT.
Figure 13B:
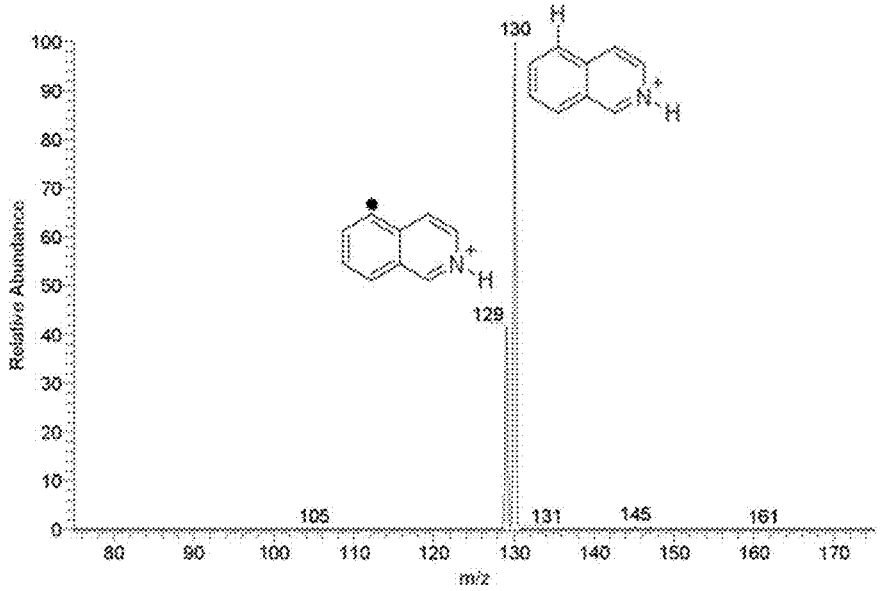
FIG. 13B is the mass spectrum measured after 500 ms reaction of the 5-dehydroisoquinolinium cation with cyclohexane in the front trap of the DLQIT.

Removal of Interfering Background Gases Using 5-Dehydroisoquinolinium Ion and Cyclohexane Finally, the removal of reactive background gases that interfere with ion/molecule reactions was studied by examining the observed reactivity of the 5-dehydroisoquinolinium ion towards cyclohexane in a single-trap LQIT (FIG. 13A) and in the DLQIT 100 (FIG. 13B). To accomplish this, 5-iodoisoquinoline was introduced into the gas phase by positive-ion mode APCI and protonated (m/z 256). When subjected to ion source CAD upon injection into an LQIT, it generated a distonic radical cation by a homolytic cleavage of the iodine-carbon bond to yield an ion of m/z 129. This distonic ion (m/z 129) was allowed to react for 500 ms with cyclohexane introduced via the ion/molecule reagent manifold of the DLQIT 100. When this reaction was performed in a single-trap LQIT, several product ions were observed, as shown in FIG. 13A, in addition to the real product ion of protonated isoquinoline (m/z 130) that resulted from reactions of the distonic ion with reactive background gases ($O_2$, $H_2O$, etc.). When this same reaction was performed in the front trap of the DLQIT 100, as shown in FIG. 13B, these unwanted background product ions were reduced and mostly eliminated. The single product ion expected for this reaction, hydrogen atom abstraction (ion of m/z 130), can be clearly seen in FIG. 13B and is virtually the only product ion observed of significant abundance when compared with the reaction spectrum gained from the single-trap LQIT shown in FIG. 13A.

Traditionally, tandem mass spectrometry experiments using either collision-activated dissociation (CAD) or ion/molecule reactions of isolated ions have been a vital tool for the structural characterization of unknown compounds directly in mixtures. When these two tandem mass spectrometry methods are used together, the power of their utility is fully realized providing elemental connectivity of unknown ions. However, the use of these tandem mass spectrometric techniques, together, without interference is not possible with currently available instrumentation. A novel mass spectrometer, a dual linear quadrupole ion trap mass spectrometer (DLQIT) of the present disclosure allows for the investigation of ions' structures via CAD and ion/molecule reactions separately without interference through the use of two, separated reaction environments or ion traps. In some embodiments, the DLQIT mass spectrometer provides for a lower partial pressure of reactive background gases that complicate CAD and ion/molecule reaction product spectra resulting in cleaner tandem mass spectrometry experiments. Also, in an illustrative embodiment, separating the space in which CAD and ion/molecule reactions are performed affords for less complicated product spectra and a greater degree of certainty of the product ions formed in these reactions.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A system comprising:

a first mass spectrometer comprising a first ion trap in a first vacuum chamber;

a second mass spectrometer comprising a second ion trap in a second vacuum chamber; and a vacuum manifold operably connecting the first and second vacuum chambers such that charged particles travel from the first vacuum chamber into the second vacuum chamber.

2. The system according to claim 1, wherein the vacuum manifold contacts the first mass spectrometer at a back portion and contacts the second mass spectrometer at a front portion.

3. The system according to claim 2, wherein the second ion trap is a linear quadrupole ion trap.

4. The system according to claim 3, wherein the first ion trap is a linear quadrupole ion trap.

5. The system according to claim 4, further comprising:

a first multipole and a first lens operably associated with the first ion trap; and a second multipole and a second lens operably associated with the second ion trap.

6. The system according to claim 5, further comprising an ion introduction multipole positioned between the ionization source and the first multipole.

7. The system according to claim 5, wherein the first lens is disposed linearly between the ion introduction multipole and the first multipole.

8. The system according to claim 5, wherein the second lens is disposed linearly between the first linear quadrupole ion trap and the second multipole.

9. The system according to claim 5, wherein the first ion trap, the vacuum manifold, and said second ion trap are arranged linearly.

10. The system according to claim 4, wherein the first ion trap is arranged at an angle to the second ion trap.

11. The system according to claim 1, wherein the vacuum manifold comprises a multipole.

12. The system according to claim 11, wherein the multipole in the vacuum chamber is configured to allow ions to travel from the first mass spectrometer to the second mass spectrometer.

13. The system according to claim 1, further comprising an ionization source operably associated with the first mass spectrometer.

14. The system according to claim 13, wherein the ionization source is an atmospheric pressure ionization source.

15. The system according to claim 1, wherein the first trap mass spectrometer is configured for performing a first gas phase ion reaction and the second mass spectrometer is configured for performing a second gas phase ion reaction.

16. The system according to claim 15, wherein the first gas phase ion reaction and the second gas phase ion reaction are selected from the group consisting of collision activated dissociation reactions, ion-molecular interaction, ion-ion reactions, and photon-induced dissociation reactions.

17. The system according to claim 1, wherein the system is configured to utilize a direct current power source.

18. The system according to claim 1, further comprising an RF power amplifier.

* * * * *